United States Patent [19]

Hughes et al.

[11] 4,370,592

[45] Jan. 25, 1983

[54] COLOR PICTURE TUBE HAVING AN IMPROVED INLINE ELECTRON GUN WITH AN EXPANDED FOCUS LENS

[75] Inventors: Richard H. Hughes; Bruce G. Marks, both of Lancaster, Pa.

[73] Assignee: RCA Corporation, New York, N.Y.

[21] Appl. No.: 201,692

[22] Filed: Oct. 29, 1980

[51] Int. Cl.[3] ..... H01J 29/50; H01J 29/56

[52] U.S. Cl. ..... 313/414; 313/449; 313/460

[58] Field of Search ..... 313/414, 409, 412, 449, 313/458, 460

[56] References Cited

U.S. PATENT DOCUMENTS

| | | | |
|---|---|---|---|
| 2,732,511 | 10/1956 | Dichter | 313/460 X |
| 3,932,786 | 1/1976 | Campbell | 313/3 |
| 3,987,328 | 10/1976 | Yoshida | 313/414 |
| 4,049,991 | 9/1977 | Collins | 313/417 |
| 4,086,513 | 4/1978 | Evans | 313/414 |
| 4,275,332 | 6/1981 | Ashizaki et al. | 313/414 |
| 4,317,065 | 2/1982 | Hughes | 313/414 |

FOREIGN PATENT DOCUMENTS 1459823 12/1976 United Kingdom .

OTHER PUBLICATIONS

1980, IEEE Chicago Spring Conference on Consumer Electronics, "A New Approach to a High Performance Electron Gun Design for Color Picture Tubes", by K. Hosokoshi et al.

*Primary Examiner*—Palmer C. Demeo
*Assistant Examiner*—Sandra L. O'Shea
*Attorney, Agent, or Firm*—Eugene M. Whitacre; Dennis H. Irlbeck

[57] ABSTRACT

The present invention relates to an improvement in a color picture tube having an inline electron gun, for generating and directing a plurality of electron beams along coplanar paths toward a screen of the tube. The gun includes a main focus lens for focusing the electron beams. The improvement comprises a change in the two spaced gun electrodes that form the main focus lens. Each electrode includes a plurality of apertures therein equal to the number of electron beams. Each electrode also includes a peripheral rim with the peripheral rims of the two electrodes facing each other. The apertured portion of each electrode is located within a recess set back from the rim. The recess has substantially straight wall sections parallel to the paths of the electron beams.

11 Claims, 9 Drawing Figures

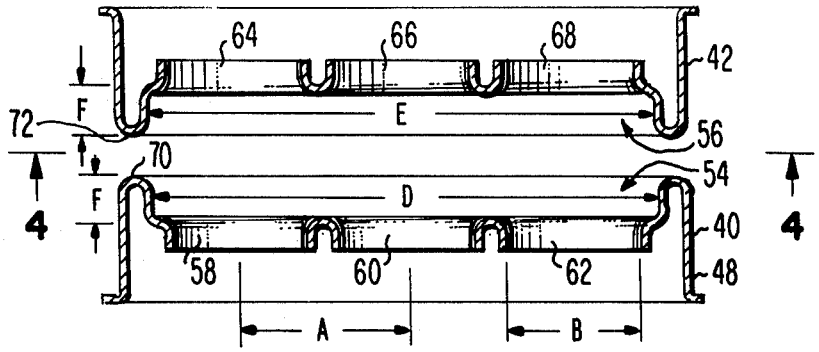
Fig. 3
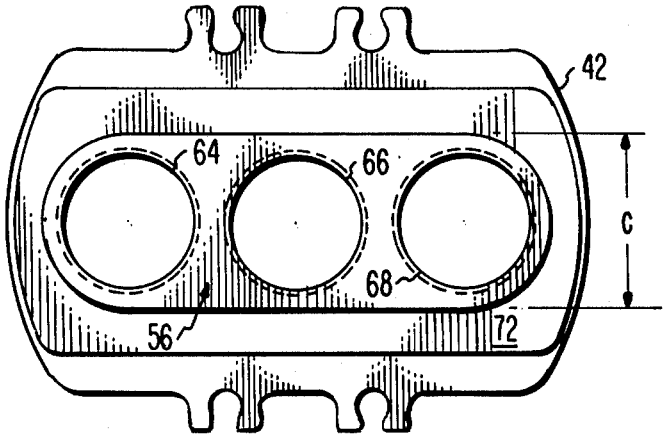
Fig. 4
Fig. 9
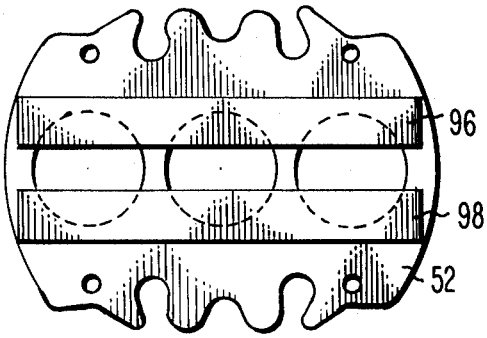

COLOR PICTURE TUBE HAVING AN IMPROVED INLINE ELECTRON GUN WITH AN EXPANDED FOCUS LENS

BACKGROUND OF THE INVENTION

The present invention relates to color picture tubes having improved inline electron guns, and particularly to an improvement in such guns for obtaining an expanded focus lens for reduced spherical aberration.

An inline electron gun is one designed to generate or initiate preferably three electron beams in a common plane and direct those beams along convergent paths in that plane to a point or small area of convergence near the tube screen. In one type of inline electron gun, such a that shown in U.S. Pat. No. 3,873,879, issued to R. H. Hughes on Mar. 25, 1975, the main electrostatic focusing lenses for focusing the electron beams are formed between two electrodes referred to as the first and second accelerating and focusing electrodes. These electrodes include two cup-shaped members having the bottoms of the members facing each other. Three apertures are included in each cup bottom to permit passage of three electron beams and to form three separate main focus lenses, one for each electron beam. In a preferred embodiment, the overall diameter of the electron gun is such that the gun will fit into a 29 mm tube neck. Because of this size requirement, the three focusing lenses are very closely spaced relative to each other thereby providing a severe limitation on focus lens design. It is known in the art that, the larger the focus lens diameter, the less will be the spherical aberration which restricts the focus quality.

In addition to the focus lens diameter, the spacing between focus lens electrode surfaces is important because greater spacing provides a more gentle voltage gradient in the lens which will also reduce spherical aberration. Unfortunately, greater spacing between electrodes beyond a particular limit (typically 1.27 mm) is not permissible because of beam bending from electrostatic charges on the neck glass penetrating into the space between the electrodes, which causes electron beam misconvergence. Therefore, there is a need for further development in design of the main focusing lens electrodes which will provide improved focus lenses having reduced spherical aberration.

SUMMARY OF THE INVENTION

In an electron gun of the tube described, the main focus lens if formed by two spaced electrodes. Each electrode includes a plurality of apertures therein equal to the number of electron beams. Each electrode also includes a peripheral rim with the peripheral rims of the two electrodes facing each other. The apertured portion of each electrode is located within a recess set back from the rim. The recess has substantially straight wall sections parallel to the paths of the electron beams.

BRIEF DESCRIPTION OF THE DRAWINGS

FIG. 3 is an axial sectional view of the G3 and G4 electrodes of the electron gun of FIG. 2.

FIG. 4 is a front view of the electron gun of FIG. 2 taken along line 4—4 of FIG. 3.

FIG. 9 is a plan view of the G4 electrode of the electron gun of FIG. 2 taken along line 9—9 of FIG. 2.

DETAILED DESCRIPTION OF THE PREFERRED EMBODIMENT

Figure 1:
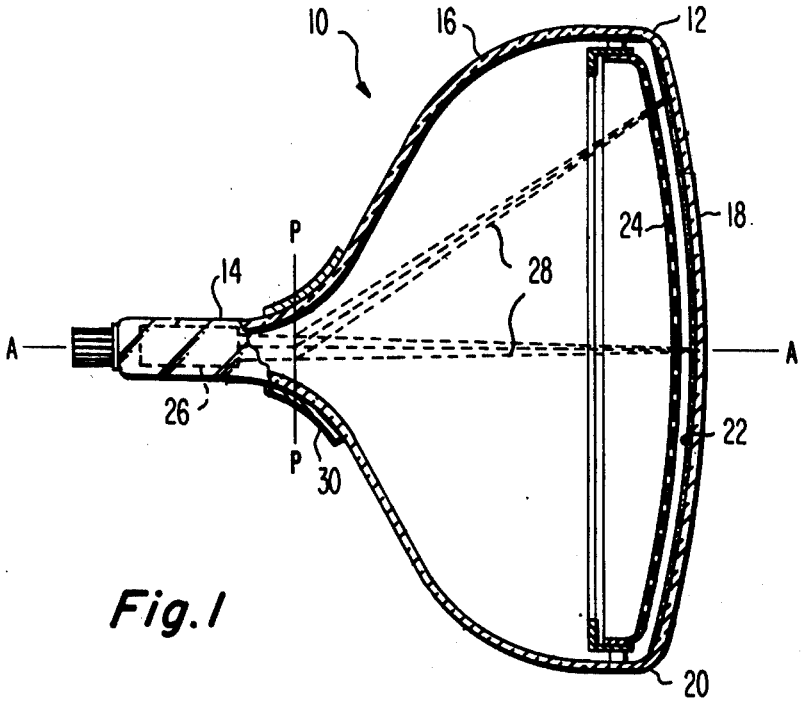
FIG. 1 is a plan view, partly in axial section, of a shadow mask color picture tube embodying the invention.

FIG. 1 is a plan view of a rectangular color picture tube having a glass envelope 10 comprising a rectangular faceplate panel or cap 12 and a tubular neck 14 connected by a rectangular funnel 16. The panel comprises a viewing faceplate 18 and peripheral flange or sidewall 20 which is sealed to the funnel 16. A mosaic three-color phosphor screen 22 is carried by the inner surface of the faceplate 18. The screen is preferably a line screen with the phosphor lines extending substantially perpendicular to the high frequency raster line scan of the tube (normal to the plane of FIG. 1). A multi-apertured color selection electrode or shadow mask 24 is removably mounted, by conventional means, in predetermined spaced relation to the screen 22. An improved inline electron gun 26, shown schematically by dotted lines in FIG. 1, is centrally mounted within the neck 14 to generate and direct three electron beams 28 along coplanar convergent paths through the mask 24 to the screen 22.

The tube of FIG. 1 is designed to be used with an external magnetic deflection yoke, such as the yoke 30 schematically shown surrounding the neck 14 and funnel 12 in the neighborhood of their junction. When activated, the yoke 30 subjects the three beams 28 to vertical and horizontal magnetic flux which cause the beams to scan horizontally and vertically, respectively, in a rectangular raster over the screen 22. The initial plane of deflection (at zero deflection) is shown by the line P—P in FIG. 1 at about the middle of the yoke 30. Because of fringe fields, the zone of deflection of the tube extends axially, from the yoke 30 into the region of the gun 26. For simplicity, the actual curvature of the deflected beam paths in the deflection zone is not shown in FIG. 1.

Figure 2:
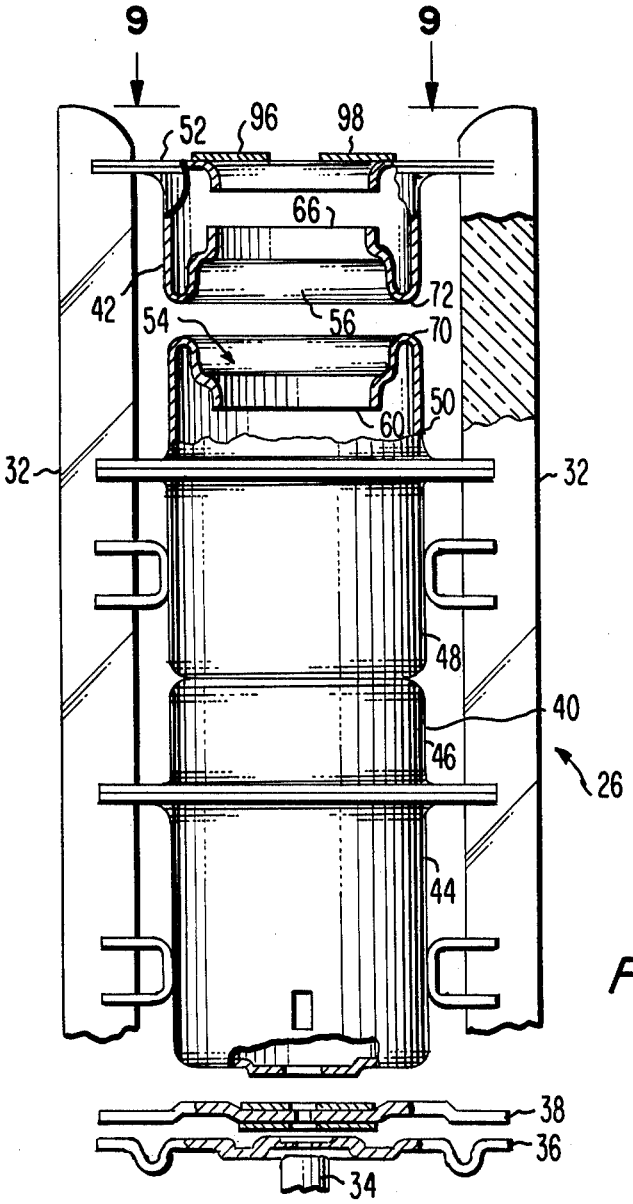
FIG. 2 is a partial axial section view of the electron gun shown in dashed lines in FIG. 1.

The details of the gun 26 are shown in FIGS. 2 through 4. The gun comprises two glass support rods 32 on which the various electrodes are mounted. These electrodes include three equally spaced coplanar cathodes 34 (one for each beam), a control grid electrode 36 (G1), a screen grid electrode 38 (G2), a first accelerating and focusing electrode 40 (G3), and a second accelerating and focusing electrode 42 (G4), spaced along the glass rods 32 in the order named. All of the electrodes have three inline apertures in them to permit passage of three coplanar electron beams. The maiin electrostatic focusing lens in the gun 26 is formed between the G3 electrode 40 and the G4 electrode 42. The G3 electrode 40 is formed with four cup-shaped elements 44, 46, 48 and 50. The open ends of two of these elements, 44 and 46, are attached to each other, and the open ends of the other two elements, 48 and 50, are also attached to each other. The closed end of the third element 48 is attached to the closed end of the second element 46. Although the G3 electrode 40 is shown as a four-piece structure, it could be fabricated from any number of elements, including a single element of the same length. The G4 electrode 42 is also cup-shaped, but has its open end closed with an apertured plate 52.

The facing closed ends of the G3 electrode 40 and the G4 electrode 42 have large recesses 54 and 56, respectively, therein. The recesses 54 and 56 set back the portion of the closed end of the G3 electrode 40 that contains three apertures 58, 60 and 62 from the portion of the closed end of the G4 electrode 42 that contains three apertures 64, 66 and 68. The remaining portions of the closed ends of the G3 electrode 40 and the G4 electrode 42 form rims 70 and 72, respectively, that extend peripherally around the recesses 54 and 56. The rims 70 and 72 are the closest portions of the two electrodes 40 and 42 to each other.

Figure 6:
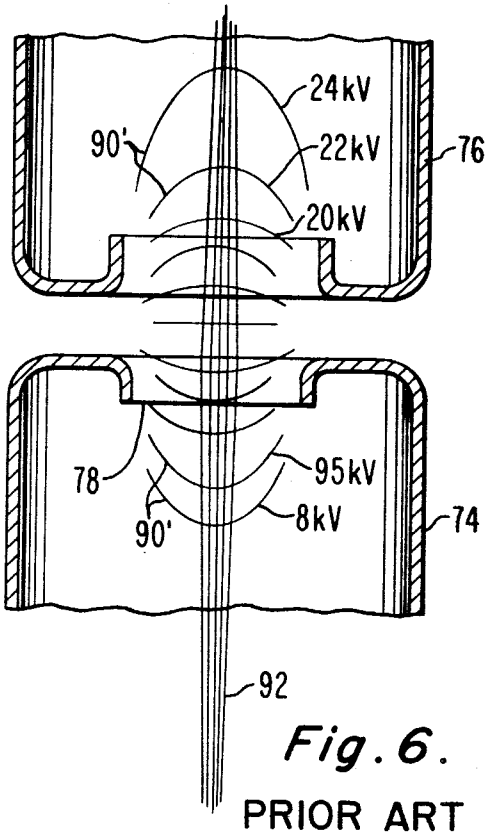
Fig. 6. PRIOR ART
FIGS. 5 and 6 are axial sectional top and side views, respectively, of the focusing lens electrodes of a prior art electron gun showing some equipotential lines of the elctrostatic focusing lens fields. The view of FIG. 6 is taken at line 6—6 of FIG. 5.
Figure 5:
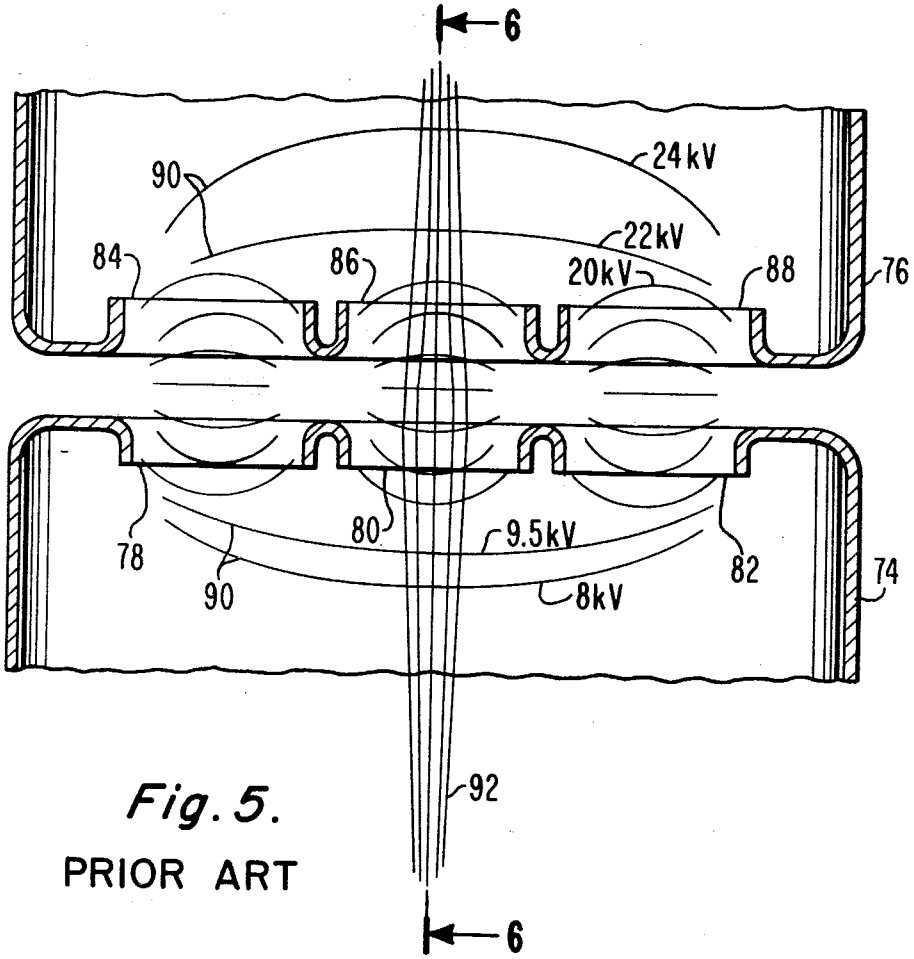
Fig. 5. PRIOR ART

FIGS. 5 and 6 show top and side sectional views, respectively, of two electrodes 74 and 76 that form the main focusing lens of a prior art electron gun of the unitized type. The electrode 74 is the G3 electrode and the electrode 76 is the G4 electrode. The electrode 74 is cup-shaped and has three separate apertures 78, 80 and 82 in its bottom. Similarly, the electrode 76 is cup-shaped and has three separate apertures 84, 86 and 88 in its bottom. During tube operation, a potential of 7 kV is applied to the G3 electrode 74 and a potential of 25 kV is applied to the G4 electrode 76. Because of these potentials, an electrostatic field is established in the vicinity of the G3 electrode apertures 78, 80 and 82 and the G4 electrode apertures 84, 86 and 88. The shape of the equipotential lines of this electrostatic field determines the main focusing lens of the prior art gun. Some of these equipotential lines 90 are shown in FIGS. 5 and 6. A comparison of these equipotential lines 90 indicates that the curvature of the outer lines 90 in the top view of FIG. 5 is substantially less than the curvature of the outer lines 90' of the side view of FIG. 6. Such difference of curvature is especially noted in the equipotential lines of 8, 9.5, 22 and 24 kV. Because of this difference of curvature, referred to as astigmatism, an electron beam 92 passing through the center apertures 80 and 89 will be focused more vertically, as shown in FIG. 6, than horizontally, as shown in FIG. 5. However, as can be seen in FIG. 5, the two outer electron beams will encounter greater electrostatic line curvatures than the center beam and therefore will be horizontally focused slightly more than the center beam, resulting in slightly less astigmatism for the outer beams.

Figure 8:
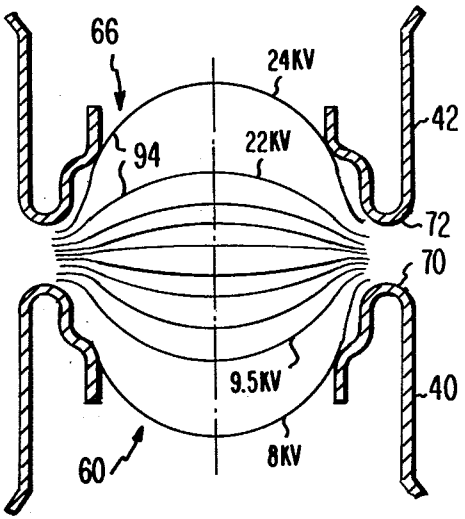
FIGS. 7 and 8 are axial sectional top and side views, respectively, of the focusing lens electrodes of the electron gun of FIG. 2 showing some equipotential lines of electrostatic focusing lens fields. The view of FIG. 8 is taken at line 8—8 of FIG. 7.
Figure 7:
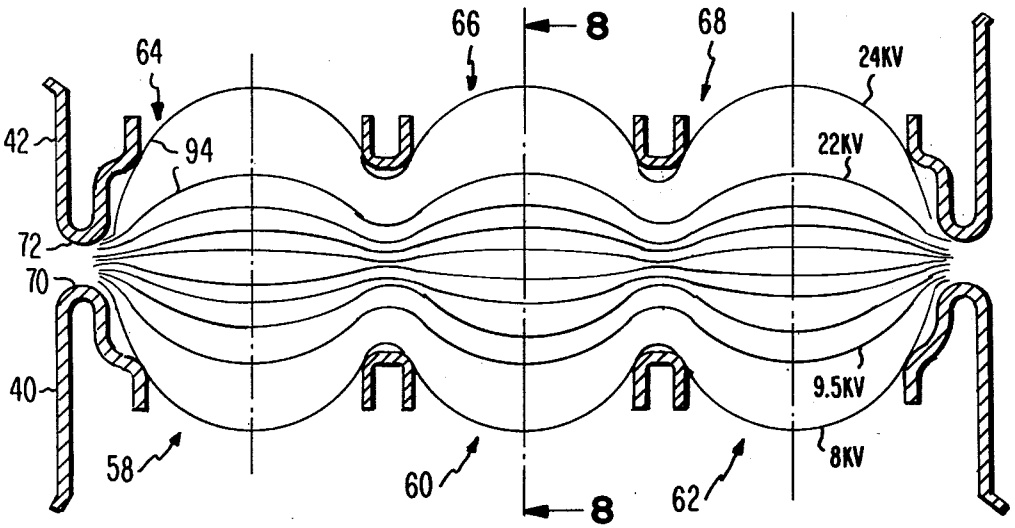

As better shown in FIGS. 7 and 8, the improved electron gun 26 of FIG. 2 provides a main focusing lens having substantially reduced spherical aberration compared to that described with respect to the prior art gun of FIGS. 5 and 6. The reduction in spherical aberration is caused by the increase in the size of the main focus lens. This increase in size results from recessing the electrode apertures. In the prior art gun of FIGS. 5 and 6, the strongest equipotential lines of the electrostatic field are concentrated at each opposing air of apertures. However, in the gun 26 of FIG. 2, the strongest equipotential lines extend continuously from between the rims 70 and 72, so that the predominant portion of the main focus lens appears to be a single large lens extending through the three electron beam paths. The remaining portion of the main focus lens is formed by weaker equipotential lines located at the apertures in the electrodes. Some of the equipotential lines 94 of the main focusing field of the improved electron gun 26 are shown in the top and side views of FIGS. 7 and 8, respectively. As can be seen, the vertical curvature of the equipotential lines, shown in FIG. 8, is more similar to the horizontal curvature, shown in FIG. 7, than as shown in the similar views for the prior art gun. Because of this similarity of curvatures, an electron beam passing along one of the electron beam paths will be focused more equally in the vertical and horizontal planes. Therefore, the type of astigmatism previously noted with respect to the prior art gun of FIGS. 5 and 6 is greatly reduced.

Preferably, in the improved gun 26 (FIGS. 3 and 4), the depths "F" of the recesses 54 and 56 are roughly one-quarter the spacings "C" between the two straight sides of the recesses. The diameter of the apertures in the G3 electrode 40 is such as to just touch an equipotential line within 4% of the electrode voltage that would exist if the apertured portion of the electrode were not present. In the embodiment shown, this 4% line is approximately a semicircle. Spacing of the two electrodes 40 and 42 should be close enough to exclude neck charging from bending the electron beams.

There is a slot effect astigmatism formed by the main focusing lens because of penetration of the focusing field through the open area of the recesses. This effect can be noted by comparing the compression of the equipotential lines 94 at the sides of the FIG. 7 embodiment with the compression of the same lines at the two areas near the center of the focus lens. This field penetration causes the focus lens to have greater vertical lens strength than horizontal lens strength. A correction is made for this astigmatism in the electron gun 26 of FIG. 2 by the inclusion of a horizontal slot opening at the exit of the G4 electrode 42. The slot is optimum at one-half the lens diameter in width and is preferably spaced at 86% of the lens diameter from the opposite surface of the G4 electrode. This slot is formed by two strips 96 and 98, shown in FIGS. 2 and 9, welded to the apertured plate 50 of the 4 electrode 42 so as to extend across the three apertures in the plate 50.

To statically converge the two outer beams with the center beam, the width "E" of the recess 56 in the G4 electrode 42 is slightly greater than the width "D" of the recess 54 in the G3 electrode 40 (FIG. 3). The effect of the greater recess width in the G4 electrode 42 is the same as that discussed with respect to the off-set apertures in U.S. Pat. No. 3,772,554, issued to R. H. Hughes on Nov. 13, 1973.

Some typical dimensions for the electron gun 26 of FIG. 2 are presented in the following table.

TABLE

| | |
|---|---|
| External diameter of tube neck | 29.00mm |
| Internal diameter of tube neck | 24.00mm |
| Spacing between 63 and 64 electrodes 40 and 42 | 1.27mm |
| Center-to-center spacing between adjacent apertures in G3 electrode 40 (A in FIG. 3) | 6.60mm |
| Inner diameter of apertures 58, 60 and 62 in G3 electrode 40 (B in FIG. 3) | 5.44mm |
| Spacing between two straight sides of recesses in the electrodes 40 and 42 (C in FIG. 4) | 6.99mm |
| Width of recess in the G3 electrodes 40 (D in FIG. 3) | 20.19mm |
| Width of recess in the G4 electrode 42 (E in FIG. 3) | 20.80mm |
| Depth of recess in the electrodes 40 and 42 (F in FIG. 3) | 1.65mm |

In various other inline electron gun embodiments, the depth of the recess in the electrodes 40 and 42 may vary from 1.30 mm to 2.80 mm.

What is claimed is:

1. In a color picture tube havinng an inline electron gun for generating and directing a plurality of electron beams along coplanar paths toward a screen of said tube, said gun including a main focus lens for focusing said electron beams, the improvement comprising the main focus lens being formed by two spaced electrodes, each electrode including a portion having a plurality of apertures therein equal to the number of electron beams, each electrode also including a peripheral rim, the peripheral rims of the two electrodes facing each other, the apertured portion of each electrode being within a recess set back from the rim, said recess having substantially straight wall sections parallel to the coplanar paths of the electron beams.

2. The tube as defined in claim 1, wherein the recess width in the plane of the electron beams is greater in the main focus lens electrode closest to the screen than in the other main focus lens electrode.

3. In a color picture tube having an inline electron gun for generating and directing three electron beams along coplanar paths toward a screen of said tube, said gun including a main focus lens for focusing said electron beams, the improvement comprising the main focus lens being formed by two spaced electrode members each having three separate inline apertures therein, each electrode also including a peripheral rim, the peripheral rims of the two electrodes facing each other, the apertured portion of each electrode being within a recess set back from the rim, the rims having substantially straight sections parallel to the coplanar paths of the electron beams.

4. The tube as defined in claim 3, wherein the recess width in the plane of the electron beams is greater in the main focus lens electrode closest to the screen than in the other main focus lens electrode.

5. In a color picture tube having an inline electron gun for generating and directing a plurality of electron beams along coplanar paths toward a screen of said tube, said gun including a main focus lens for focusing said electron beams, the improvement comprising the main focus lens being formed by two spaced electrodes, each electrode including a portion having a plurality of apertures therein equal to the number of electron beams, each electrode also including a peripheral rim, the peripheral rims of the two electrodes facing each other, the apertured portion of each electrode being within a recess set back from the rim, and means on said gun for correcting for astigmatism formed by the main focus lens.

6. The tube is defined in claim 5, wherein the recess width in the plane of the electron beams is greater in the main focus lens electrode closest to the screen than in the other main focus lens electrode.

7. The tube as defined in claim 5 wherein said means for correcting for astigmatism comprises a slot on said gun located between the main focus lens and said screen.

8. The tube as defined in claim 7 wherein said slot is formed by two strips.

9. In a color picture tube having an inline electron gun for generating and directing three electron beams along coplanar paths toward a screen of said tube, said gun including a main focus lens for focusing said electron beams, the improvement comprising the main focus lens being formed by two spaced electrode members each having three separate inline apertures therein, each electrode also including a peripheral rim, the peripheral rims of the two electrodes facing each other, the apertured portion of each electrode being within a recess set back from the rim, and the electrode of said main focus lens closest to said screen including a slot on the side facing the screen, said slot extending across the three electron beam paths.

10. The tube as defined in claim 9, wherein the recess width in the plane of the electron beams is greater in the main focus lens electrode closest to the screen than in the othermain focus lens electrode.

11. The tube as defined in claim 9, wherein said slot of said plate is formed by two strips.

* * * * *

REEXAMINATION CERTIFICATE (238th)

United States Patent [19] [11] B1 4,370,592

Hughes et al. [45] Certificate Issued Aug. 28, 1984

[54] COLOR PICTURE TUBE HAVING AN IMPROVED INLINE ELECTRON GUN WITH AN EXPANDED FOCUS LENS

[75] Inventors: Richard H. Hughes; Bruce G. Marks, both of Lancaster, Pa.

[73] Assignee: RCA Corporation, New York, N.Y.

Reexamination Request:
No. 90/000,457, Oct. 7, 1983

Reexamination Certificate for:

| | |
|---|---|
| Patent No.: | **4,370,592** |
| Issued: | **Jan. 25, 1983** |
| Appl. No.: | **201,692** |
| Filed: | **Oct. 29, 1980** |

[51] Int. Cl.[3] ..... H01J 29/50; H01J 29/56

[52] U.S. Cl. ..... 313/414; 313/449; 313/460

[58] Field of Search ..... 313/414, 412, 409, 448, 313/458, 460

[56] References Cited

U.S. PATENT DOCUMENTS

| | | | |
|---|---|---|---|
| 3,265,915 | 8/1966 | Thomas | 313/414 |
| 4,029,988 | 6/1977 | Say | 313/414 |
| 4,086,513 | 4/1978 | Evans | 313/414 |
| 4,317,065 | 2/1982 | Hughes | 313/414 |

FOREIGN PATENT DOCUMENTS

| | | |
|---|---|---|
| 51-52668[U] | 4/1976 | Japan . |
| 52-70748 | 6/1977 | Japan . |
| 1496057 | 12/1977 | United Kingdom . |

*Primary Examiner*—Palmer C. Demeo

[57] ABSTRACT

The present invention relates to an improvement in a color picture tube having an inline electron gun, for generating and directing a plurality of electron beams along coplanar paths toward a screen of the tube. The gun includes a main focus lens for focusing the electron beams. The improvement comprises a change in the two spaced gun electrodes that form the main focus lens. Each electrode includes a plurality of apertures therein equal to the number of electron beams. Each electrode also includes a peripheral rim with the peripheral rims of the two electrodes facing each other. The apertured portion of each electrode is located within a recess set back from the rim. The recess has substantially straight wall sections parallel to the paths of the electron beams.

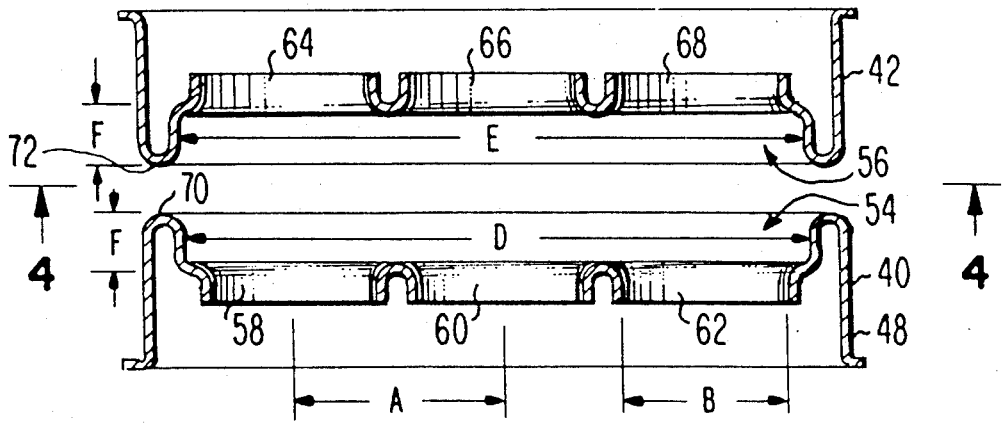

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, Lines 12–34:

An inline electron gun is one designed to generate or initiate preferably three electron beams in a common plane and direct those beams along convergent paths in that plane to a point or small area of convergence near the tube screen. In one type of inline electron gun, such *as* [a] that shown in U.S. Pat. No. 3,873,879, issued to R. H. Hughes on Mar. 25, 1975, the main electrostatic focusing lenses for focusing the electron beams are formed between two electrodes referred to as the first and second accelerating and focusing electrodes. These electrodes include two cup-shaped members having the bottoms of the members facing each other. Three apertures are included in each cup bottom to permit passage of three electron beams and to form three separate main focus lenses, one for each electron beam. In a preferred embodiment, the overall diameter of the electron gun is such that the gun will fit into a 29 mm tube neck. Because of this size requirement, the three focusing lenses are very closely spaced relative to each other thereby providing a severe limitation on focus lens design. It is known in the art that, the larger the focus lens diameter, the less will be the spherical aberration which restricts the focus quality.

Column 1, Lines 51–59:

In an electron gun of the tube described, the main focus lens *is* [if] formed by two spaced electrodes. Each electrode includes a plurality of apertures therein equal to the number of electron beams. Each electrode also includes a peripheral rim with the peripheral rims of the two electrodes facing each other. The apertured portion of each electrode is located within a recess set back from the rim. The recess has substantially straight wall sections parallel to the paths of the electron beams.

Column 2, Lines 3–7:

FIGS. 5 and 6 are axial sectional top and side views, respectively, of the focusing lens electrodes of a prior art electron gun showing some equipotential lines of the [elctrostatic] *electrostatic* focusing lens fields. The view of FIG. 6 is taken at line 6—6 of FIG. 5.

Column 2, Line 52–Column 3, Line 19:

The details of the gun 26 are shown in FIGS. 2 through 4. The gun comprises two glass support rods 32 on which the various electrodes are mounted. These electrodes include three equally spaced coplanar cathodes 34 (one for each beam), a control grid electrode 36 (G1), a screen grid electrode 38 (G2), a first accelerating and focusing electrode 40 (G3), and a second accelerating and focusing electrode 42 (G4), spaced along the glass rods 32 in the order named. All of the electrodes have three inline apertures in them to permit passage of three coplanar electron beams. The [maiin] *main* electrostatic focusing lens in the gun 26 is formed between the G3 electrode 40 and the G4 electrode 42. The G3 electrode 40 is formed with four cup-shaped elements 44, 46, 48 and 50. The open ends of two of these elements, 44 and 46, are attached to each other, and the open ends of the other two elements, 48 and 50, are also attached to each other. The closed end of the third element 48 is attached to the closed end of the second element 46. Although the G3 electrode 40 is shown as a four-piece structure, it could be fabricated from any number of elements, including a single element of the same length. The G4 electrode 42 is also cup-shaped, but has its open end closed with an apertured plate 52.

The facing closed ends of the G3 electrode 40 and the G4 electrode 42 have large recesses 54 and 56, respectively, therein. The recesses 54 and 56 set back the portion of the closed end of the G3 electrode 40 that contains three apertures 58, 60 and 62 from the portion of the closed end of the G4 electrode 42 that contains three apertures 64, 66 and 68. The remaining portions of the closed ends of the G3 electrode 40 and the G4 electrode 42 form rims 70 and 72, respectively, that extend peripherally around the recesses 54 and 56. The rims 70 and 72 are the closed portions of the two electrodes 40 and 42 to each other.

Column 3, Lines 20–51:

FIGS. 5 and 6 show top and side sectional views, respectively, of two electrodes 74 and 76 that form the main focusing lens of a prior art electron gun of the unitized type. The electrode 74 is the G3 electrode and the electrode 76 is the G4 electrode. The electrode 74 is cup-shaped and has three separate apertures 78, 80 and 82 in its bottom. Similarly, the electrode 76 is cup-shaped and has three separate apertures 84, 86 and 88 in its bottom. During tube operation, a potential of 7 kV is applied to the G3 electrode 74 and a potential of 25 kV is applied to the G4 electrode 76. Because of these potentials, an electrostatic field is established in the vicinity of the G3 electrode apertures 78, 80 and 82 and the G4 electrode apertures 84, 86 and 88. The shape of the equipotential lines of this electrostatic field determines the main focusing lens of the prior art gun. Some of these equipotential lines 90 are shown in FIGS. 5 and 6. A comparison of these equipotential lines 90 indicates that the curvature of the outer lines 90 in the top view of FIG. 5 is substantially less than the curvature of the outer lines 90' of the side view of FIG. 6. Such difference of curvature is especially noted in the equipotential lines of 8, 9.5, 22 and 24 kV. Because of this difference of curvature, referred to as astigmatism, an electron beam 92 passing through the center apertures 80 and [89] *86* will be focused more vertically, as shown in FIG. 6, than horizontally, as shown in FIG. 5. However, as can be seen in FIG. 5, the two outer electron beams will encounter greater electrostatic line curvatures than the center beam and therefore will be horizontally focused slighly more than the center beam, resulting in slightly less astigmatism for the outer beams.

Column 3, Line 52–Column 4, Line 13:

As better shown in FIGS. 7 and 8, the improved electron gun 26 of FIG. 2 provides a main focusing lens having substantially reduced spherical aberration compared to that described with respect to the prior art gun of FIGS. 5 and 6. The reduction in spherical aberration is caused by the increase in the size of the main focus lens. This increase in size results from recessing the electrode apertures. In the prior art gun of FIGS. 5 and 6, the strongest equipotential lines of the electrostatic field are concentrated at each opposing [air] *pair* of apertures. However, in the gun 26 of FIG. 2, the strongest equipotential lines extend continuously from between the rims 70 and 72, so that the predominant portion of the main focus lens appears to be a single large lens extending through the three electron beam paths. The remaining portion of the main focus lens is formed by weaker equipotential lines located at the apertures in the electrodes. Some of the equipotential lines 94 of the main focusing field of the improved electron gun 26 are shown in the top and side views of FIGS. 7 and 8, respectively. As can be seen, the vertical curvature of the equipotential lines, shown in FIG. 8, is more similar to the horizontal curvature, shown in FIG. 7, than as shown in the similar views for the prior art gun. Because of this similarity of curvatures, an electron beam passing along one of the electron beam paths will be focused more equally in the vertical and horizontal planes. Therefore, the type of astigmatism previously noted with respect to the prior art gun of FIGS. 5 and 6 is greatly reduced.

Column 4, Lines 26–43:

There is a slot effect astigmatism formed by the main focusing lens because of penetration of the focusing field through the open area of the recesses. This effect can be noted by comparing the compression of the equipotential lines 94 at the sides of the FIG. 7 embodiment with the compression of the same lines at the two areas near the center of the focus lens. This field penetration causes the focus lens to have greater vertical lens strength than horizontal lens strength. A correction is made for this astigmatism in the electron gun 26 of FIG. 2 by the inclusion of a horizontal slot opening at the exit of the G4 electrode 42. The slot is optimum at one-half the lens diameter in width and is preferably spaced at 86% of the lens diameter from the opposite surface of the G4 electrode. This slot is formed by two strips 96 and 98, shown in FIGS. 2 and 9, welded to the apertured plate 50 of the [4] *G4* electrode 42 so as to extend across the three apertures in the plate 50.

AS A RESULT OF REEXAMINATION, IT HAS BEEN DETERMINED THAT:

Claims 1, 5, 9 and 10 are determined to be patentable as amended.

Claims 2–4, 6–8 and 11, dependent on an amended claim, are determined to be patentable.

1. In a color picture tube [havinng] *having* an inline electron gun for generating and directing a plurality of electron beams along coplanar paths toward a screen of said tube, said gun including a main focus lens for focusing said electron beams, the improvement comprising the main focus lens being formed by two spaced electrodes, each electrode including a portion having a plurality of apertures therein equal to the number of electron beams, each electrode also including a peripheral rim, the peripheral rims of the two electrodes facing each other, the apertured portion of each electrode being within a recess set back from the rim, said recess having substantially straight wall sections parallel to the coplanar paths of the electron beams.

5. In a color picture tube having an inline electron gun for generating and directing a plurality of electron beams along coplanar paths toward a screen of said tube, said gun including a main focus lens for focusing said electron beams, the improvement comprising the main focus lens being formed by two spaced electrodes, each electrode including a portion having a plurality of *inline* apertures therein equal to the number of electron beams, each electrode also including a peripheral rim, the peripheral rims of the two electrodes facing each other, the apertured portion of each electrode being within a recess set back from the rim, *the recess in each electrode having a greater dimension in the inline direction of said inline apertures than in a direction perpendicular to the inline direction of said inline apertures,* and means on said gun for correcting for astigmatism formed by the main focus lens.

9. In a color picture tube having an inline electron gun for generating and directing three electron beams along coplanar paths toward a screen of said tube, said gun including a main focus lens for focusing said electron beams, the improvement comprising the main focus lens being formed by two spaced electrode members each having three separate inline apertures therein, each electrode also including a peripheral rim, the peripheral rims of the two electrodes facing each other, the apertured portion of each electrode being within a recess set back from the rim, *the recess in each electrode having a greater dimension in the inline direction of said inline apertures than in a direction perpendicular to the inline direction of said inline apertures,* and the electrode of said main focus lens closest to said screen including a slot on the side facing the screen, said slot extending across the three electron beam paths.

10. The tube as defined in claim 9, wherein the recess width in the plane of the electron beams is greater in the main focus lens electrode closest to the screen than in the [othermain] *other main* focus lens electrode.

* * * * *

US004370592B1

REEXAMINATION CERTIFICATE (3808th)

United States Patent [19] [11] B1 4,370,592

Hughes et al. [45] Certificate Issued Jul. 13, 1999

[54] COLOR PICTURE TUBE HAVING AN IMPROVED INLINE ELECTRON GUN WITH AN EXPANDED FOCUS LENS

[75] Inventors: Richard H. Hughes; Bruce G. Marks, both of Lancaster, Pa.

[73] Assignee: RCA Licensing Corporation, Princeton, N.J.

Reexamination Request:
No. 90/004,767, Sep. 11, 1997

Reexamination Certificate for:

| | |
|---|---|
| Patent No.: | **4,370,592** |
| Issued: | **Jan. 25, 1983** |
| Appl. No.: | **06/201,692** |
| Filed: | **Oct. 29, 1980** |

[51] Int. Cl.[6] ..... H01J 29/50; H01J 29/56
[52] U.S. Cl. ..... 313/414; 313/449; 313/460
[58] Field of Search ..... 313/414, 449, 313/460

[56] References Cited

U.S. PATENT DOCUMENTS 3,772,554 11/1973 Hughes .
4,275,332 6/1981 Ashizaki .

FOREIGN PATENT DOCUMENTS 52-114655 8/1977 Japan .
54-49862 4/1979 Japan .

*Primary Examiner*—Vip Patel

[57] ABSTRACT

The present invention relates to an improvement in a color picture tube having an inline electron gun, for generating and directing a plurality of electron beams along coplanar paths toward a screen of the tube. The gun includes a main focus lens for focusing the electron beams. The improvement comprises a change in the two spaced gun electrodes that form the main focus lens. Each electrode includes a plurality of apertures therein equal to the number of electron beams. Each electrode also includes a peripheral rim with the peripheral rims of the two electrodes facing each other. The apertured portion of each electrode is located within a recess set back from the rim. The recess has substantially straight wall sections parallel to the paths of the electron beams.

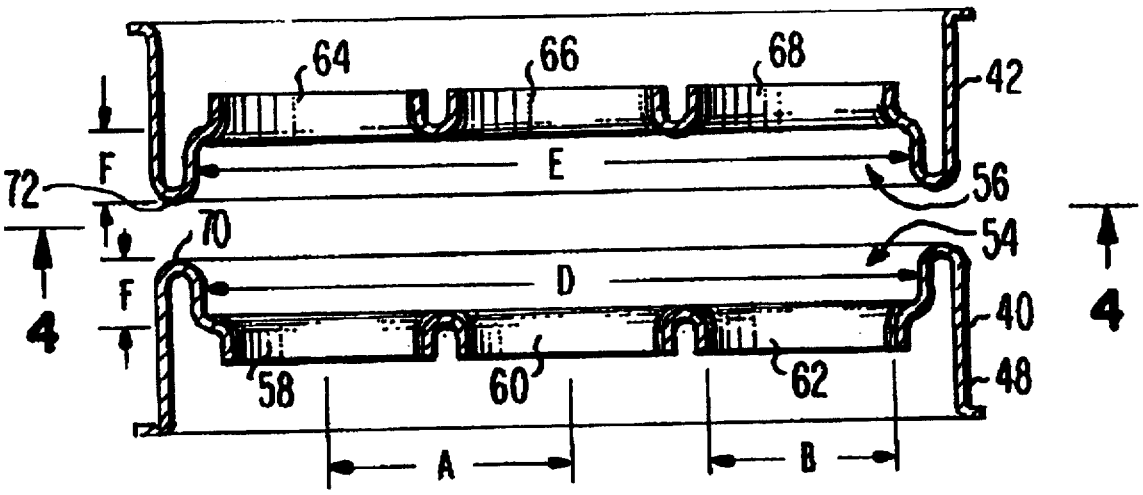

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 5–11 is confirmed.

Claims 1–4 are cancelled.

Claims 12 and 13 are added and determined to be patentable.

*12. In a color picture tube having an inline electron gun for generating and directing a plurality of electron beams along coplanar paths toward a screen of said tube, said gun including a main focus lens for focusing said electron beams, the improvement comprising*

*the main focus lens being formed by two spaced electrodes, each electrode including a portion having a plurality of apertures therein equal to the number of electron beams, each electrode also including a peripheral rim, the peripheral rims of the two electrodes facing each other, the apertured portion of each electrode being within a recess set back from the rim, said recess having substantially straight wall sections parallel to the coplanar paths of the electron beams, and curved wall sections transversing the coplanar paths of the electron beams, wherein the recess width in the plane of the electron beams is greater in the main focus lens electrode closest to the screen than in the other main focus lens electrode.*

*13. In a color picture tube having an inline electron gun for generating and directing a plurality of electron beams along coplanar paths toward a screen of said tube, said gun including a main focus lens for focusing said electron beams, the improvement comprising*

*the main focus lens being formed by two spaced electrode members each having three separate inline apertures therein, each electrode also including a peripheral rim, the peripheral rims of the two electrodes facing each other, the apertured portion of each electrode being within a recess set back from the rim, the rims having substantially straight sections parallel to the coplanar paths of the electron beams, and curved sections transversing the coplanar paths of the electron beams, wherein the recess width in the plane of the electron beams is greater in the main focus lens electrode closest to the screen than in the other main focus lens electrode.*

* * * * *